United States Patent [19]

Bacher

[11] 4,117,425

[45] Sep. 26, 1978

[54] MICROWAVE STEP ATTENUATOR

[76] Inventor: Helmut Bacher, 771 Quince Orchard #11, Gaithersburg, Md. 20760

[21] Appl. No.: 763,824

[22] Filed: Jan. 31, 1977

[51] Int. Cl.[2] ..... H01P 1/22

[52] U.S. Cl. ..... 333/81 A; 333/97 R

[58] Field of Search ..... 333/81 R, 81 A

[56] References Cited

U.S. PATENT DOCUMENTS

| | | | |
|---|---|---|---|
| 3,553,608 | 1/1971 | Mison | 333/81 A |
| 3,665,347 | 5/1972 | Barth | 333/81 A |

FOREIGN PATENT DOCUMENTS

| | | | |
|---|---|---|---|
| 25,907 | 7/1972 | Japan | 333/81 A |

*Primary Examiner*—Paul L. Gensler

*Attorney, Agent, or Firm*—Robert K. Youtie

[57] ABSTRACT

A microwave attenuator including inner and outer conductors defining a transmission path, and attenuator means extending between the inner and outer conductors and including specifically configured resistive means extending transversely of and electrically connected between the inner and outer conductors.

10 Claims, 9 Drawing Figures

FIG. 1
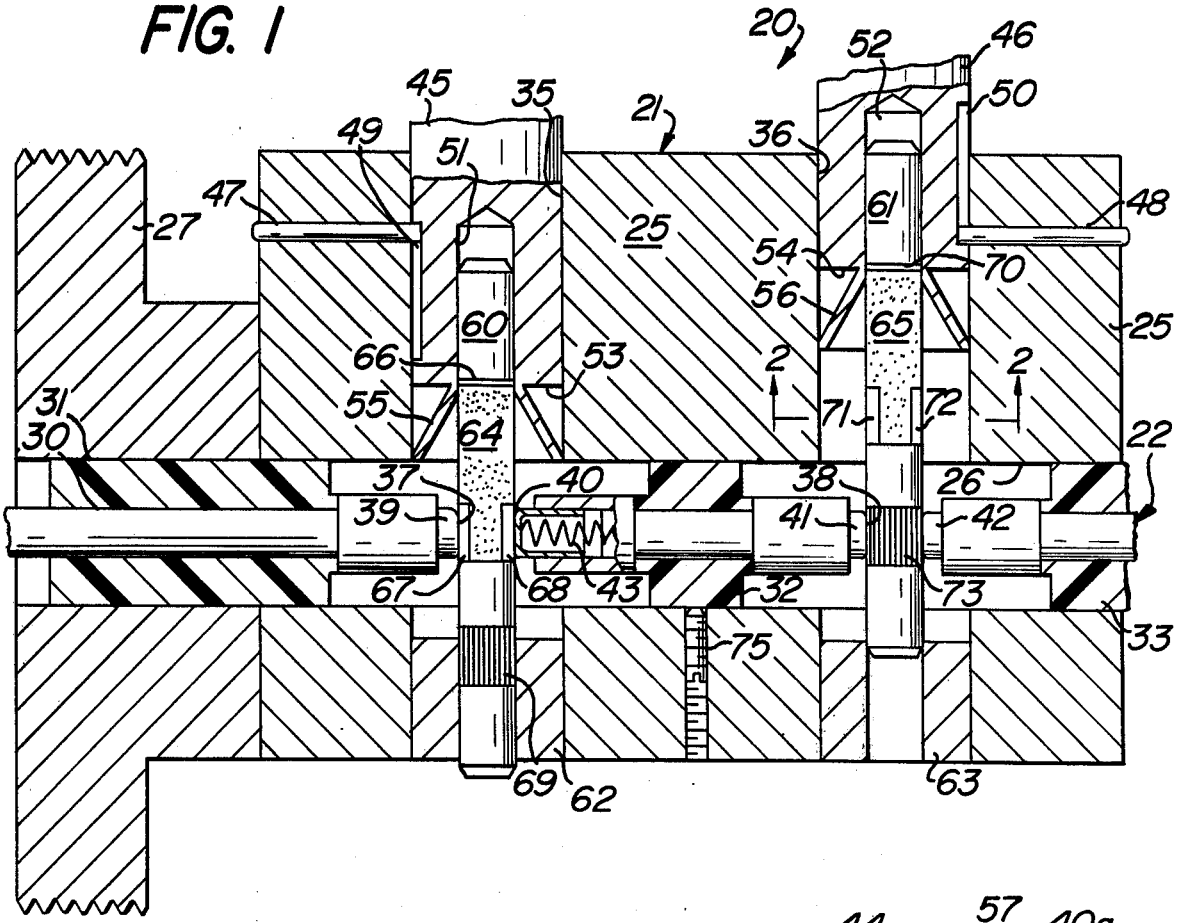
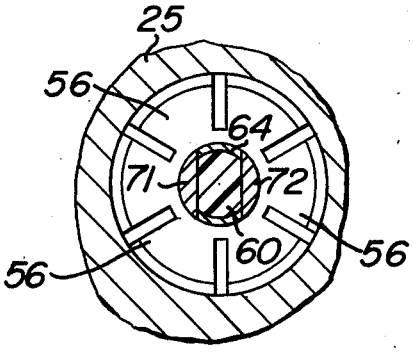
FIG. 2
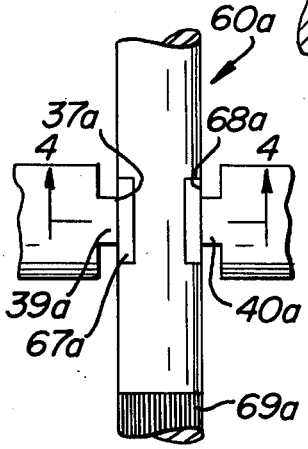
FIG. 3
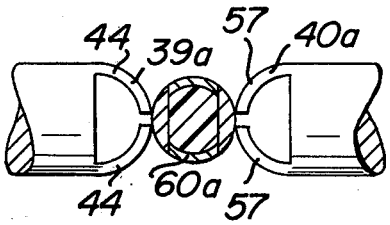
FIG. 4

FIG. 5
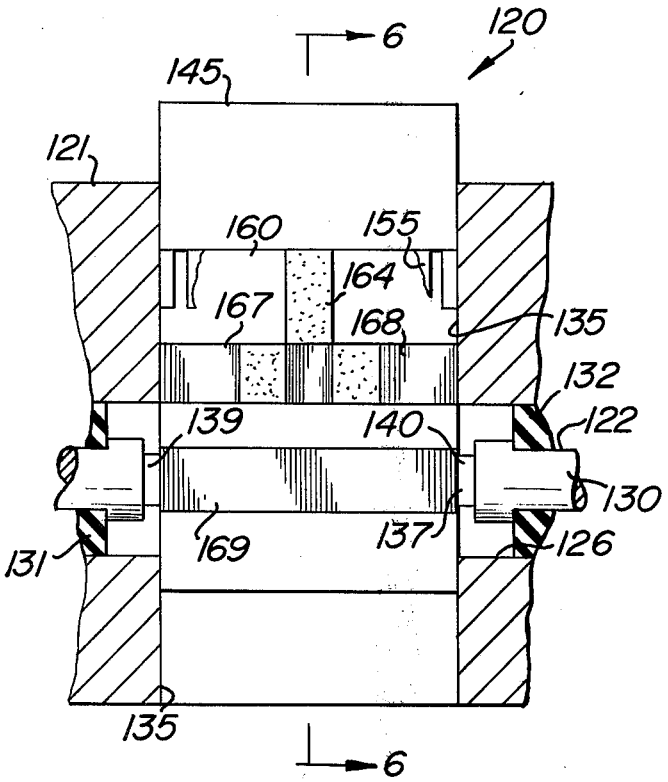
FIG. 6
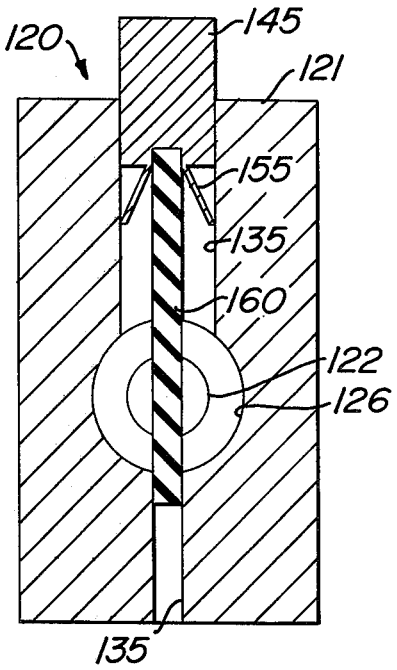
FIG. 9
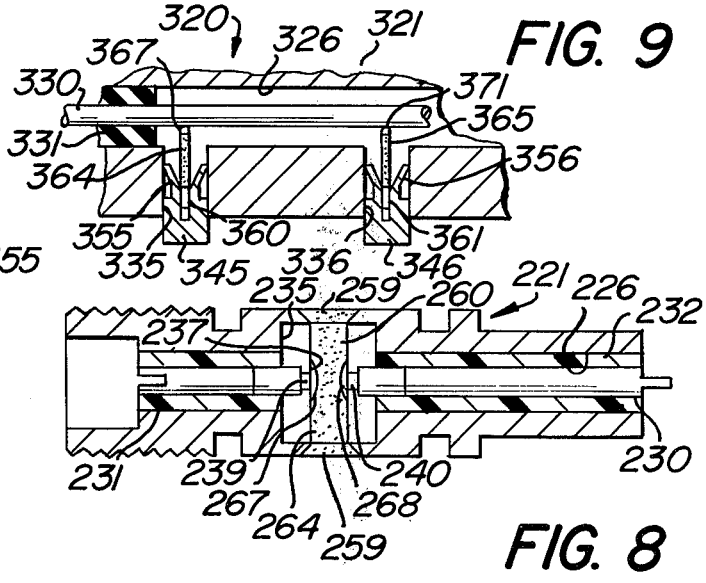
FIG. 7
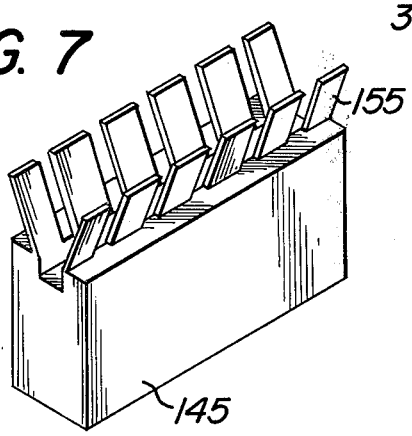
FIG. 8

MICROWAVE STEP ATTENUATOR

BACKGROUND OF THE INVENTION

While there are, in the prior art, a variety of microwave step attenuators, including those employing the binary approach, and those employing the rotary or drum approach. Such attenuators have not been entirely satisfactory, especially as being relatively complex and costly, lacking in durability and reliability.

SUMMARY OF THE INVENTION

It is an important object of the present invention to provide a uniquely improved microwave attenuator of the step type which overcomes the above-mentioned difficulties of the prior art, being extremely simple in construction and design, and durable and reliable throughout a long useful life.

It is another object of the present invention to provide a microwave step attenuator having the advantageous characteristics mentioned in the preceding paragraph, which is well adapted for wide versatility in use, being operable manually and automatically, both directly and remotely, selectively configured to achieve desired impedance match and frequency response, and wherein the essential concepts can be employed both in switchable and fixed attenuators to achieve substantial economies in manufacture and maintenance.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a longitudinal sectional view showing the attenuator construction of the present invention in a microwave path.

FIG. 2 is a partial sectional view taken generally along the line 2—2 of FIG. 1.

FIG. 3 is a fragmentary view showing a slightly modified embodiment of attenuator construction.

FIG. 4 is a partial sectional view taken generally along the line 4—4 of FIG. 3.

FIG. 5 is a longitudinal sectional view similar to FIG. 1, but showing another embodiment of attenuator of the present invention.

FIG. 6 is a transverse sectional view taken generally along the line 6—6 of FIG. 5.

FIG. 7 is a perspective view showing a component of the embodiment of FIGS. 6 and 7 apart therefrom.

FIG. 8 is a longitudinal sectional view showing a further embodiment of the present invention, illustrating a fixed attenuator.

FIG. 9 is a longitudinal sectional view showing still another embodiment of the present invention.

BRIEF DESCRIPTION OF THE PREFERRED EMBODIMENTS

Referring now more particularly to the drawings, and specifically to FIGS. 1 and 2 thereof, a microwave transmission line is there generally designated 20, including an elongate, centrally hollow or generally tubular outer conductor 21, and an elongate inner conductor

22 disposed longitudinally of and spacedly within the outer conductor. The outer conductor 21 may include a metallic or otherwise conductive body 25 having a longitudinal through bore 26, and provided on one or more ends with a connection member 27 or other suitable coupling means.

The inner conductor 22 includes an elongate metallic wire member or rod 30, supported in its spaced relation within the outer member 21 by surrounding dielectric collars, tubes or beads, as at 31, 32 and 33, which may be fabricated of suitable insulating material, such as plastic or the like, each having an axial central bore conformably receiving the inner conductor member 30 to support the same axially within the outer conductor longitudinal passageway 26.

The outer conductor body 25 may be provided with one or more transverse through bores or open-ended holes, as at 35 and 36. That is, the through bores 35 and 36 each extend transversely through the body 25 and intersect with the longitudinal through bore 26. In practice, the transverse bores 35 and 36 may be generally parallel to each other.

The inner conductor 22 is provided with an interruption or gap, as at 37 and 38. The gap or interruption 37 is generally in alignment with the transverse bore 35, spaced between the inner conductor supports or beads 31 and 32, and the gap or interruption 38 is generally in alignment with the transverse bore 36, spaced between the inner conductor supports or beads 32 and 33. Each of the inner conductor gaps 37 and 38 may be considered as defined by a pair of adjacent spaced, aligned end portions of the inner conductor, such as the spaced aligned end portions 39 and 40 defining therebetween the interruption or gap 37, and the spaced aligned inner conductor end portions 41 and 42 defining therebetween the interruption or gap 38. Further, in the illustrated embodiment of FIG. 1, the end portions 39 and 40 are resiliently biased in their end-to-end spaced relation toward each other, as by a coil compression spring 43; and similarly, the facing spaced end portions 41 and 42 are suitably resiliently biased toward each other.

Slidably mounted in each transverse bore 35 and 36, on one side of the longitudinal bore 26, say the upper side as shown in FIG. 1, is a generally cylindrical member, slide or crosshead, as at 45 and 46, respectively. That is, the cylindrical members or slides 45 and 46 are slidable in their respective bores 35 and 36, and constrained to endwise sliding movement by suitable means, such as projections or pins 47 and 48 entering into respective bores 35 and 36 and there engaging in respective grooves 49 and 50 of adjacent slides 45 and 46. Centrally of each generally cylindrical slide or body 45 and 46, there is formed a generally blind hole or bore 51 and 52, respectively, which bores open through the inner end of the associated slide toward the outer conductor bore 26. On the inner end 53 and 54 of each respective slide 45 and 46, surrounding the associated blind bore 51 and 52, there is provided an annular array of obliquely inwardly extending resilient fingers or spring leaves 55 and 56, respectively. The resilient fingers or leaves 55 and 56 extend obliquely inwardly toward the longitudinal bore 26 and radially outwardly into resilient bearing engagement with the surface of the respective adjacent transverse bore 35 and 36. That is, the free ends of resilient leaves 55 and 56 are in yieldable frictional engagement with the interior surfaces of respective bores 35 and 36 to maintain electrical contact between the slides 45 and 46 and the outer conductor body 25, while retaining the slides in a selected position and permitting shifting movement of the slides to another selected position. For example, the slide 45 is shown in FIG. 1 as being in an inserted position, while the slide 46 is illustrated as in a withdrawn position, the former being an attenuating position and the latter being a nonattenuating, or zero attenuation position.

Extending from each shiftable slide or body 45 and 46 is a generally cylindrical pin or extension, as at 60 and 61, respectively. That is, each of the rods, pins or extensions 60 and 61 is of a generally cylindrical configuration, having a diameter approximating the internal diameter of bores 51 and 52 and having one end inserted snugly in the respective adjacent slide member bore. That is, the extension 60 has one end snugly inserted, and by press fit, into bore 51 of slide 45 and extends generally coaxially therefrom transversely across bore 26, through inner conductor gap 37, and into an annular receiving member or plug 62 in the lower opposite end of bore 35. Similarly, the lower end of bore 36, remote from slide member 46, is provided with an annular insert or plug 63 circumposed about and slidably receiving the adjacent end of rod or extension 61.

More specifically, the extensions 60 and 61 are each suitably fabricated of a dielectric or nonconducting material, which material may be exposed at opposite end regions of the extensions. However, an intermediate region of each extension 60 and 61 is provided with a circumferential band of resistive material, as at 64 and 65, which material may have a predetermined and selected electrical resistance. By resistive material is meant material having conductivity and substantial resistance. This is in contrast to the terms conductive or conductor by which is meant material of relatively low or negligible resistance. The resistive element or band 64 about the intermediate region of extension 60 is suitably electrically connected to slide 45, as by an annular conductor or conductive band 66. Also, provided in electrical connection with the resistive element 64, remote from the band 66, may be a pair of diametrically opposed conductors 67 and 68 for electrical contact with respective end members or contacts 39 and 40 of inner conductor 22. Thus, in the position of attenuator slide 45 shown in FIG. 1, the resistive element 64 is interposed in series electrical connection between inner conductor end contacts 39 and 40, and is interposed in shunt relation between contact 39, outer conductor slide 45 and contact 40.

In addition, the extension 60 is provided at a spaced location from resistive element 64, between the latter and the free extension end, with an annular additional conductor or band 69 of conductive material, for a purpose appearing presently.

Similarly, the intermediate resistive element or band 65 of resistive material about extension 61 of slide 46 is suitably electrically connected to the slide, as by a band of conductive material 70, while the opposite end of resistive element 65 is provided on diametrically opposite sides thereof with conductive contacts 71 and 72 for respective electrical engagement with contacts 41 and 42 of gap 38. Spaced from the resistive element 65, toward the free end of extension 61, is an additional conductor or conductive band 73 for location in shorting electrical connection between contacts 41 and 42.

In the illustrated position of FIG. 1, the attenuator slide 46 is in its zero attenuation or withdrawn position, the slide always maintaining electrical contact with the outer conductor 25. However, the contacts 71 and 72, and thereby resistive element 65, are out of electrical connection with the inner conductor 22. Rather, the additional conductor 73 has been shifted into the gap 38 to directly electrically connect and effectively short the contacts 41 and 42 for zero attenuation of the microwave signal.

The slides 45 and 46 are self-maintaining in their selective attenuating and nonattenuating positions, as by frictional engagement of the holding fingers or resilient leaves 55 and 56. The inner conductor supports or beads 31, 32 and 33 may be suitably maintained in position by any suitable means, such as a set screw 75, or other. While not specifically illustrated, it is appreciated that the shifting movement of slides 45 and 46, and any desired additional number of attenuation slides, may be suitably achieved by a wide variety of actuating means, including manual and automatic, both directly and by remote control. For example, a predetermined relationship of a plurality of such attenuation means may be achieved through a single cam shaft carrying a plurality of cams for operating the respective attenuation means.

Referring now to FIGS. 3 and 4, there is shown a slightly modified embodiment, wherein a pair of inner conductor end portions 39*a* and 40*a* define therebetween an inner conductor gap 37*a* in which is located a shiftable cylindrical pin or extension 60*a*. The pin or extension 60*a* may be substantially identical to the pin or extension 60 described hereinbefore. However, the spaced aligned end portions 39*a* and 40*a* may differ from their corresponding end portions 39 and 40. Specifically, the end portion 39*a* may be defined by a pair of arcuately inwardly extending bowed fingers or leaves 44, terminating proximate to and short of each other in resilient bearing engagement with extensions 60*a*. Similarly, the end portion 40*a* may be defined by a pair of arcuately inwardly extending bowed fingers or leaves 57*a* terminating adjacent to and spaced from each other for resilient bearing engagement with the opposite side of the extension 60*a*. In this manner, the end portions 39*a* and 40*a* assure effective electrical connection with the conductors 67*a* and 68*a*, and additional conductor 69*a*.

Referring now to the embodiment of FIGS. 5–7, there is shown therein a microwave transmission line generally designated 120, including an elongate, centrally hollow or tubular outer conductor 121 and an elongate inner conductor 122 disposed longitudinally of and spacedly within the outer conductor. The outer conductor 121 may be of any suitably conductive material and provided with a longitudinal through bore 126. The inner conductor 122 may include an elongate metallic wire member or rod 130 suitably supported in spaced relation within the outer member 121, as by conventional dielectric collars, tubes or beads, as at 131 and 132.

The outer conductor member 121 may be provided with one or more transverse through passageways or open-ended holes or bores, as at 135, which holes may be generally normal to the outer conductor 121 and intersect with the longitudinal through bore 126 of the outer conductor. A plurality of transverse holes 135 may be provided in the outer conductor 121, generally parallel to each other, as desired.

In the region of transverse hole or bore 135, the inner conductor 130 is provided with an interruption or gap, as at 137, spaced between the beads 131 and 132. The gap 137 may be considered as defined between a pair of adjacent, spaced aligned end portions 139 and 140 of the inner conductor 130, which end portions are resiliently biased toward each other in the end-to-end spaced relation, by any suitable means, such as in the embodiments of FIGS. 1–4.

The transverse through passageway, hole or bore 135 is of generally rectangular cross-section, and a generally rectangular slide member or crosshead 145 is mounted in the hole 135 for sliding movement toward and away from the central longitudinal passageway 126 of outer conductor 121. On the inner side of the slide 145, toward the longitudinal central bore 126, there are provided on the slide a plurality of resilient fingers or spring leaves 155 extending obliquely toward and into frictional retaining engagement with the internal surface of passageway 135. By this means, the slide body 145 is selectively positionable at any desired location within the passageway 135, being self-retaining at the selected position, and by electrical conductivity of the fingers 155 and slide 145, there is maintained a continuity between the outer conductor 121 and slide 145.

Extending from the slide 145, into the passageway 135, through and across the longitudinal bore 126, is a platelike extension 160 of reduced thickness, as best seen in FIG. 6. It will also there be seen that the lower region of passageway 135, below the bore 126 in FIG. 6 is of a lesser width than the upper region of passageway 135, so as to slidably receive the reduced thickness extension 160.

The platelike extension 160 is thus generally rectangular in configuration, as observed in FIGS. 5 and 6, and is advantageously fabricated of dielectric or insulating material, being fixedly secured at one end, its upper end in the drawings, to the slide body 145 and extending therefrom across the bore 126, through the inner conductor gap 137 and slidably into the lower region of passageway 135.

An intermediate region of extension 160 is provided with a surface layer or coating of resistive material, as at 164, specifically configured to afford the desired resistance, which resistive element 164 is suitably electrically connected to the conductive slide 145 and fingers 155, as well as to the spaced opposed conductors 167 and 168 carried on opposite edge regions of the extension. Spaced from the resistive element 164 and conductors 167 and 168 is an additional conductor 169 carried by the extension 160 and extending between opposite side edges of the latter. In the illustrated embodiment of FIG. 5, the additional conductor 169 is electrically connected in a shorted or zero attenuation position between contacts 139 and 140 of inner conductor 130. However, the slide body 145 and its associated extension 160 is shiftable transversely of the outer conductor 121 to place the conductors 167 and 168 in respective electrical connection with contacts 139 and 140. In this condition, shunt paths are provided between the outer conductor 121 and both inner conductor contacts 139 and 140, and the additional conductor 169 may be in the lower region of passageway 135.

Hence, in the embodiment of FIGS. 5–7, it will be apparent that the same advantageous characteristics are provided as set forth in the embodiments of FIGS. 1–4, including simplicity of construction, economy in manufacture and durability and reliability in operation. Also, actuation may be readily applied either directly or remotely by mechanical or electrical means, including cams, relays, and other suitable actuating means.

While the embodiments of FIGS. 1–6 illustrated attenuator constructions wherein only a single unit was movable to achieve a fixed attenuation or zero attenuation, as desired, and of course a plurality of such single units may be employed in a single circuit, the advantageous geometry of the configuration also lends itself to use with a very economical and highly reliable fixed attenuator, as may be seen in FIG. 8. Such a fixed attenuator may include an outer elongate, centrally hollow conductor 221 having a generally central, longitudinal bore 226 and advantageously provided on opposite ends with suitable coupling connections, as desired.

A transverse internal passageway 235 is provided in the outer conductor 221, intersecting with the longitudinal bore 226. An elongate member or extension 260 extends within the passageway 235 transversely across the bore 226, and may have its opposite ends suitably fixed, as by conductive adhesive, to the outer conductor 221, as at 259. The transverse extension 260 may be a cylindrical rod, say of dielectric or insulating material, and suitably coated with a resistive layer 264, the resistive layer being of a thickness and configuration consistent with the desired impedance. A pair of conductors 267 and 268 are located on opposite sides of the extension 260, being electrically connected through resistive coating 264 and conductive securement 259 to the outer conductor 221.

Spacedly within the longitudinal bore 226 of outer conductor 221 is an inner conductor 230 having an interruption or gap 237 defined between a pair of facing, spaced, aligned contacts 239 and 240 in electrical connection with the conductors 267 and 268. The inner conductor 230 is supported in its coaxially spaced relation within the bore 226 by one or more supports or beads 231 and 232. Thus, attenuation is achieved by the shunt paths between the outer conductor 221 and the inner conductor contacts 239 and 240, together with the series path between contacts 239 and 240 and through resistive element 264.

A further embodiment of attenuator employing the geometry of the instant invention is shown in FIG. 9, the attenuator there generally being designated 320 and including an elongate, hollow, conductive outer conductor 321 having a central longitudinally extending internal passageway or bore 326. Coaxially spaced within the bore 326 of outer conductor 321 is an inner conductor 330, suitably supported by insulating members 331.

At spaced locations along the outer conductor 321, there are provided a plurality of transverse bores or holes 335 and 336 opening into the central bore 326. A conductive body or slide, as at 345 and 346 is slidably located in each bore 335 and 336, the slides being respectively provided with diagonal leaves or fingers 355 and 356 frictionally engageable with internal surfaces of respective bores 335 and 336. The slides 345 and 346 are advantageously of metal or other conductive material, as are the spring fingers or leaves 355 and 356. An elongate rod or extension, as at 360 and 361 extends from each respective slide 345 and 346 toward and into an engagement with the adjacent region of inner conductor 330. The extensions 360 and 361 may be fabricated of dielectric or insulating material, and respectively provided with a resistive element defined by a conductive coating or layer, as at 364 and 365. The free end of each extension 360 and 361 may be provided with an electrical conductor as at 367 and 371, respectively for electrical contact and connection with the inner conductor 330. Also, the resistive elements 364 and 365 of extensions 360 and 361 are suitably electrically connected to respective spring fingers 355 and 356. Thus, the resistive elements 364 and 365 each provide a shunt resistor in the transmission line; and, selective shunt resistors may be moved into and out of the transmission line, as required. The embodiment of FIG. 9 is advantageous wherein a series resistor is not desired, as may be advantageous in octave band applications. The distance or spacing between shunt resistors is selected to achieve the best VSWR input and output. In addition, such attenuator achieves very low insertion loss.

From the foregoing, it is seen that the present invention provides a microwave attenuator capable of effecting substantial economies in attenuator manufacture, installation and use, while assuring high reliability and durability throughout a long useful life.

Although the present invention has been described in some detail by way of illustration and example for purposes of clarity of understanding, it is understood that certain changes and modifications may be made within the spirit of the invention.

What is claimed is:

1. A microwave attenuator comprising an inner conductor having a gap, an outer conductor extending along and cooperating with said inner conductor to define therealong a microwave transmission path, and attenuator means extending between said inner and outer conductor, said attenuator means comprising an elongate dielectric extension member transversely of and mounted in said outer conductor for shifting movement in said outer conductor transversely thereof and extending shiftably through said gap in bridging relation with the latter, a specifically configured resistive element carried by said extension member for movement therewith between an attenuating position electrically connecting said inner and outer conductors and an alternate position not electrically connecting said inner and outer conductors, and an additional conductor carried by said extension member for movement into said gap to electrically close the latter in said not electrically connecting position for zero attenuation, said extension member, resistive element and additional conductor being substantially aligned transversely of said inner and outer conductors.

2. A microwave attenuator according to claim 1, said resistive element being generally cylindrical.

3. A microwave attenuator according to claim 1, said resistive element being generally rectilinear.

4. A microwave attenuator according to claim 1, said attenuator means further comprising a conductive slide slidable transversely of and in electrical contact with said outer conductor, said dielectric extension member being fixed to and carried by said slide for movement with said slide relative to said inner conductor.

5. A microwave attenuator according to claim 4, said slide including contact arms extending into frictional engagement with said outer conductor for holding said slide in a selected position of movement.

6. A microwave attenuator according to claim 5, said resistive element and additional conductor being spaced longitudinally of said dielectric extension.

7. a microwave attenuator comprising an inner conductor, an outer conductor extending along and cooperating with said inner conductor to define therealong a microwave transmission path, and attenuator means extending between said inner and outer conductors, said attenuator means comprising a specifically configured resistive element extending transversely of and electrically connected between said inner and outer conductors, said attenuator means further comprising a conductive slide slidable transversely of and in electrical contact with said outer conductor, said resistive element extending in fixed relation from said slide toward said inner conductor for movement with said slide relative to said inner conductor, said slide including contact arms extending into frictional engagement with said outer conductor for holding said slide in a selected position of movement, said outer conductor having a transverse bore, said slide being shiftable in said bore, and said contact arms extending obliquely oppositely toward the interior surfaces of said bore for said frictional engagement.

8. A microwave attenuator according to claim 7, said inner conductor having a gap, said resistive element being shiftable into and out of said gap for movement into and out of said electrically connected relation, and said attenuator means including an additional conductor for movement into said gap to electrically close the latter when said resistive element is shifted out of said gap for zero attenuation.

9. A microwave attenuator according to claim 8, in combination with a dielectric extension from said slide, said resistive element extending from said slide along said dielectric extension for movement into and out of contact with said inner conductor.

10. A microwave attenuator according to claim 9, said resistive element terminating short of the distal end of said dielectric extension, and said additional conductor being on said dielectric extension spaced from said resistive element.

* * * * *